United States Patent [19]

Morgan

[11] 4,076,184

[45] Feb. 28, 1978

[54] APPARATUS FOR REELING WEB- OR STRAND-LIKE MATERIAL

[75] Inventor: John Henry Morgan, Dursley, England

[73] Assignee: John Morgan Printing Machinery Ltd., England

[21] Appl. No.: 677,137

[22] Filed: Apr. 15, 1976

[30] Foreign Application Priority Data

Apr. 17, 1975 United Kingdom ..... 15915/75

[51] Int. Cl.[2] ..... B65H 23/16

[52] U.S. Cl. ..... 242/75.3; 242/75.51

[58] Field of Search ..... 242/75, 75.3, 75.51, 242/75.52, 75.53; 226/195

[56] References Cited

U.S. PATENT DOCUMENTS

| | | | |
|---|---|---|---|
| 3,249,315 | 5/1966 | Peltier | 242/75.3 |
| 3,595,492 | 7/1971 | Furst | 242/75.51 |
| 3,650,490 | 3/1972 | Sounders | 242/75.3 |
| 3,701,493 | 10/1972 | Weisch | 242/75.51 |

FOREIGN PATENT DOCUMENTS

| | | | |
|---|---|---|---|
| 587,286 | 1/1959 | Italy | 242/75.51 |

*Primary Examiner*—Edward J. McCarthy
*Attorney, Agent, or Firm*—Emory L. Groff, Jr.

[57] ABSTRACT

An apparatus for reeling web or strand-like material comprises sensing means for sensing the tension in the material to be reeled, a separate non-driven control cylinder which has a non-slip surface around which the material is to pass, the control cylinder having brake means acting thereon under control means responsive to the sensing means.

10 Claims, 2 Drawing Figures

APPARATUS FOR REELING WEB- OR STRAND-LIKE MATERIAL

BACKGROUND OF THE INVENTION

This invention relates to apparatus for reeling web- or strand-like material.

There are many instances where a manufacturing or treatment machine for an elongate web- or strand-like material ends in a re-reeling of the material. An example is a printing machine for continuous stationery. It is important, in the latter case in particular, that the printed paper web should be uniformly wound i.e. with controlled tension, on the reel. Otherwise subsequent handling of the web e.g. accurate interleaving of a number of zig-zag folded webs, may be possible.

In the past, even the use of a set of dancer rolls to absorb changes in the web speed compared with the reeling speed, or the use of a constant torque drive to the final reel, have not provided satisfactory re-reeling. This is because of the high speed of the web and the consequent inability of the dancer rolls and the drive to adjust quickly enough.

SUMMARY OF THE INVENTION

It is an object of the invention to overcome or at least reduce the problems mentioned above.

According to the invention, there is provided an apparatus for reeling web or strand like material comprising sensing means for sensing the tension in the material to be reeled, a non-driven control cylinder separate from said sensing means and with a non-slip surface around which the material is to pass, brake means acting on said control cylinder and control means responsive to said sensing means to provide actuation of said brake means in dependence thereon.

BRIEF DESCRIPTION OF THE DRAWINGS

The invention will now be described in greater detail, by way of example, with reference to the drawings, in which.

DESCRIPTION OF THE PREFERRED EMBODIMENTS

Figure 1:
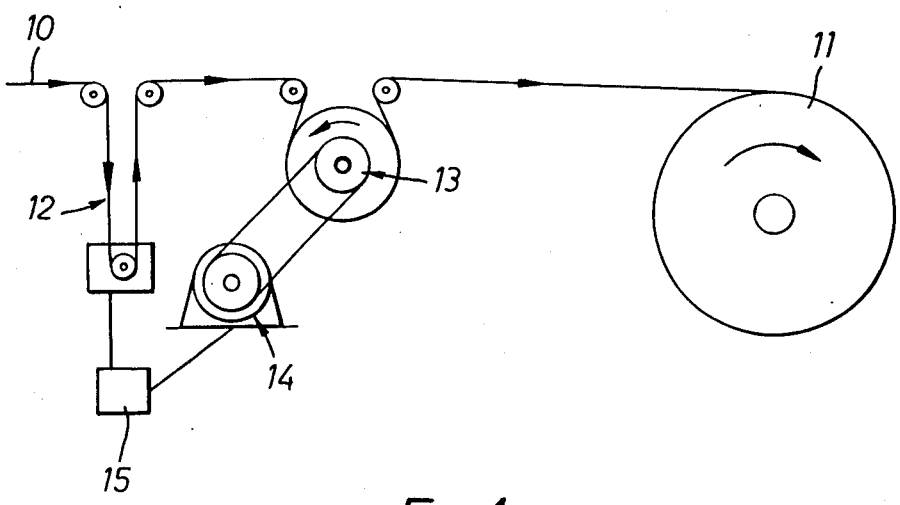
FIG. 1 shows the schematic layout of a reeling apparatus according to the invention.

A web of paper 10 emerges from a printing machine (not shown) and is reeled onto a final reel 11. Between the printing machine (or any other processing machine) and the final reel, the paper web passes through a dancer roll assembly 12 and around a control cylinder 13. The latter is freely rotatable in friction-minimising bearings and has a cylindrical surface which is prepared or coated so as to inhibit slipping of the paper web passing around it. The rotation of the cylinder 13 can be controlled by a brake 14, which is itself controlled by the position of the dancer roll of assembly 12 through control means indicated at 15. This brake 14 is preferably an electrically actuated magnetic particle brake.

The final reel 11 is driven by an electric motor which is, for example, of settable but constant torque, e.g. the motor is a constant torque motor whose torque can be set. If the reel 11 is prevented from rotating for any reason, the electric motor slips electrically.

By means of this arrangement it becomes possible to greatly improve the reeling, and additionally to isolate the tension in the final reel from the operating tension in the printing machine and vice versa.

In normal operation, the final reel 11 is driven at its set torque by the electric motor. The dancer roll is in the region of its lowest position and the control cylinder is rotating freely.

There is no slip between the web and the friction surface of the control cylinder.

If now the printing machine slows down, for example, the dancer roll tends to move upwards, since the inertia of the final reel and the constant torque drive of the motor will continue to draw the web even though it is no longer issuing so fast from the machine. As the dancer roll moves up, it adjusts the brake 14 through the control 15 so that the cylinder 13 and the web 10 are smoothly braked against the pull of the final reel 11. The tension in the web being reeled cannot increase above the level set by the predetermined maximum torque of the drive motor, and if the cylinder 13 is braked more than a certain amount, the motor slips. Even if the dancer roll moves right to the top of its travel, so that it cannot any longer perform its normal buffer function, the cylinder 13 will be braked to a standstill without any harm to the web, without the reeling tension being affected, and without the reeling tension being 'reflected back' into the printing machine.

Once the supply of the web from the machine speeds up (or starts again), the dancer roll starts to drop, and the brake 14 starts to be released. The web starts to increase its speed (or starts to move) and the reeling eventually returns again to normal.

In practice, this control sequence occurs very frequently and very rapidly, constantly adjusting the flow of the web to the final reel in accordance with the supply from the printing machine. The result is an almost complete isolation of the reeling process from the printing (or other handling) process, as desired, although both remain continuous and simultaneous.

Figure 2:
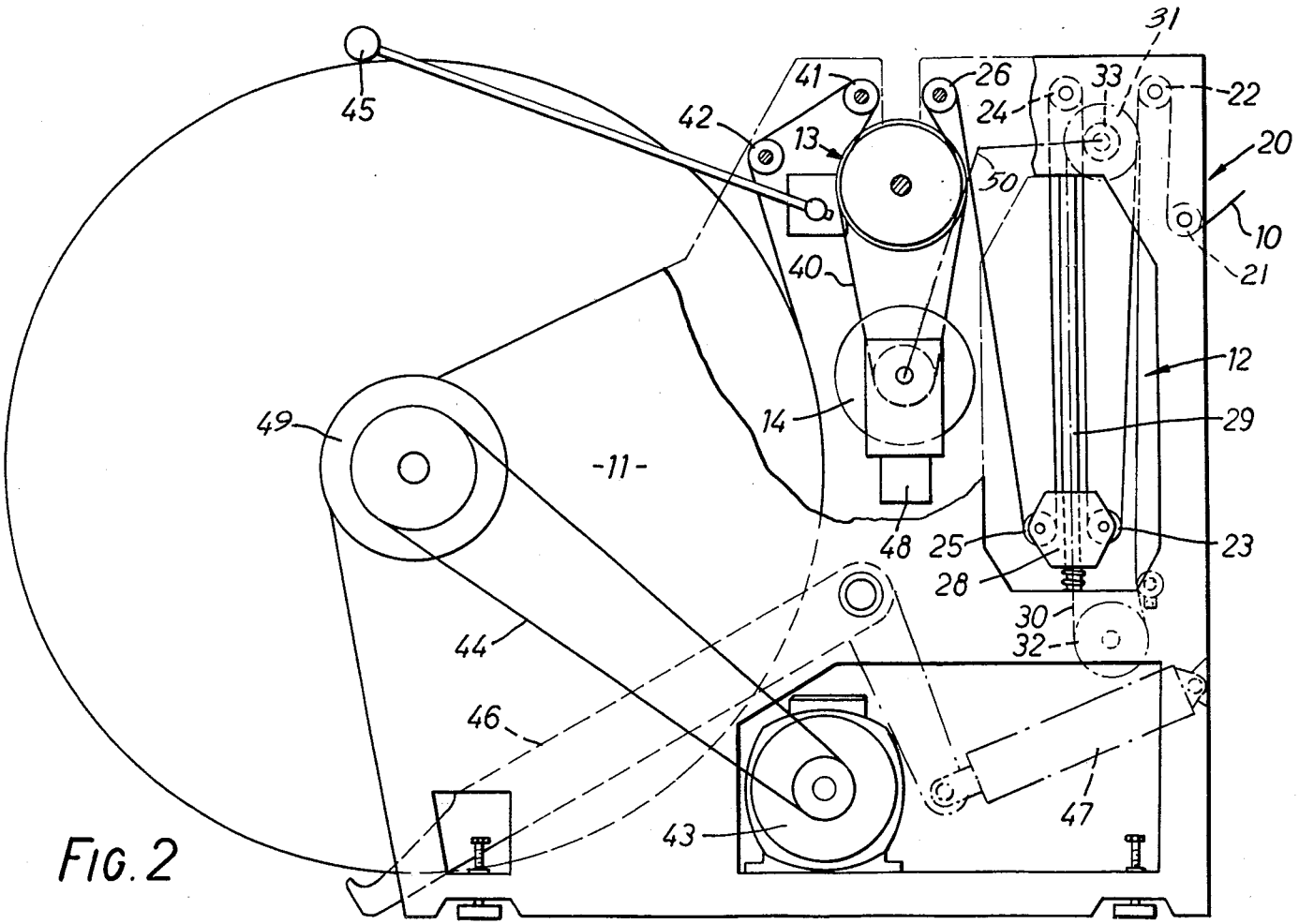
FIG. 2 shows a side elevation of a reeling apparatus operating as in FIG. 1.

Turning now to FIG. 2, which shows more practical details, the same reference numerals are applied to parts which correspond to those in FIG. 1. The apparatus comprises a frame 20, the side members 21 of which support the various rolls and cylinders. The web 10 passes through substantially the same path as was described for FIG. 1.

The web 10 arrives in the apparatus by way of a first fixed roll 21 and passes upwards therefrom to the first fixed roll 22 of the dance roll assembly 12. From the roll 22, the web 10 proceeds downwardly, around the first dancer roll 23, upwardly to the second fixed roll 24, upwardly again to the second dancer roll 25 and upwardly again to the third stationary roll 26. The dancer rolls 23 and 25 are supported at each end in bearings in a framework 28 which moves upwardly and downwardly on a post 29. The framework 28 is supported by an endless chain 30. The chain 30 extends around sprockets 31 and 32, the uppermost 31 of which is coupled to a rotary potentiometer indicated diagrammatically at 33. The latter is connected electrically by a line indicated at 50 so as to control the electrically actuated magnetic particle brake 14. At and near the lowermost position of the dancer roll frame 28, the electrical supply determined by the potentiometer 31 is such as to reduce the effect of the brake 14 to a minimum residual level; as the dancer roll frame 28 rises, the braking effect is steadily increased, until in the uppermost position the brake 14 is fully applied.

The brake 14, mounted on a cross beam 48, is a magnetic particle brake which is linked by a belt 40 to the control cylinder 13. The web 10 is deflected by the fixed rollers 26 so that it is wrapped around at least half the circumference of the cylinder 13 to a further fixed roller 41. The latter has an outer cylindrical surface which is rendered rough by metal spraying. There is thus no slip possible between the web 10 and the cylindrical surface.

The web finally passes by way of yet a further fixed roller 42 to the final reel 11, which is supported in bearings 49 and is driven by a motor 43. The latter is designed to deliver a constant, pre-settable torque through the chain drive 44. On its own, this would not lead to a constant tension in the reeled web, because the torque acts on a constantly increasing lever arm as the radius of the reel increases. If desired, a control sensor 45 may be provided, biassed (here, by gravity) to contact and sense the radius of the reel, and its angular position can be used directly or indirectly to pre-set the torque of the motor 43. Alternatively manual control can be used.

A lifting device 46, operated by a hydraulic cylinder 47 is used to lift a completed reel from the bearings 42.

The operation of this apparatus is in principle exactly as described with reference to FIG. 1. The principle can be applied to the reeling of many materials other than paper, e.g. textiles, cables, threads and tapes.

The brake may be of any desired type, operable for example by mechanical, electrical, hydraulic or pneumatic means. The control cylinder, may have any convenient frictional surface. The sending of the position of the dancer roll may be affected by any other suitable means, e.g. by photoelectric sensing means, or inductive field sensing. Indeed the roller itself may be omitted and only the position of the loop of the web detected.

The control cylinder may have a counter roller to prevent slipping of the web.

I claim:

1. An apparatus for reeling web or strand-like material comprising sensing means for sensing the tension in the material to be reeled, a non-driven control cylinder separate from said sensing means and with a non-slip surface around which the material is to pass, brake means acting on said sensing means to provide actuation of said brake means in dependence thereon.

2. An apparatus as claimed in claim 1, wherein said sensing means comprises means for forming a deflection loop of the material to be reeled, whose size is indicative of the tension in the material.

3. Apparatus as claimed in claim 2, wherein said brake means comprises an electrically actuated brake.

4. Apparatus as claimed in claim 3, wherein said brake means comprises a magnetic particle brake.

5. Apparatus as claimed in claim 4, wherein said means for forming a deflection loop comprises dancer roll means.

6. Apparatus as claimed in claim 5, wherein said loop sensing means comprises means for determining the position of said dancer roll means.

7. Apparatus as claimed in claim 6, wherein a reel mounting device is provided for receiving a reel and driven by an electric motor of settable constant torque.

8. Apparatus as claimed in claim 7, wherein sensing means are provided for varying said settable constant torque of said electric motor in dependence on the thickness of said reel.

9. An apparatus for reeling web or strand-like material comprising means for sensing the tension in the material to be reeled, a control cylinder with a non-slip surface around which the material is to pass, brake means acting on the control cylinder, control means responsive to the sensing means to provide actuation of the brake means in dependence therein, said tension sensing means comprising a deflection loop of the material to be reeled whose size is indicative of the tension in the material, loop sensing means, said control means comprising a potentiometer connected mechanically with said loop sensing means and electrically with the brake means.

10. An apparatus for reeling web or strand-like material comprising means for sensing the tension in the material to be reeled, a control cylinder with a non-slip surface around which the material is to pass, brake means acting on the control cylinder, control means responsive to the sensing means to provide actuation of the brake means in dependence therein, said tension sensing means comprising a deflection loop of the material to be reeled whose size is indicative of the tension in the material, loop sensing means, said control means comprising a potentiometer connected mechanically with said loop sensing means and electrically with the brake means, dancer roll means for forming said deflection loop, said loop sensing means comprising means for determining the position of said dancer roll means, said dancer roll means comprising at least one dancer roll, movable bearings carrying said at least one dancer roll, an endless chain carrying said movable bearings, a pulley on which said chain runs and which is coupled to said potentiometer.

* * * * *